United States Patent [19]

Rupprechter

[11] Patent Number: 4,914,782

[45] Date of Patent: Apr. 10, 1990

[54] WIDE-ANGLE HINGE

[75] Inventor: Helmut Rupprechter, Lauterach, Austria

[73] Assignee: Julius Blum Gesellschaft m.b.H., Höchst, Austria

[21] Appl. No.: 272,247

[22] Filed: Nov. 17, 1988

[30] Foreign Application Priority Data

Dec. 23, 1987 [AT] Austria ..... 3406/87

[51] Int. Cl.[4] ..... E05D 11/10

[52] U.S. Cl. ..... 16/319; 16/343; 16/349; 16/370; 16/371; 16/376

[58] Field of Search ..... 16/319, 349, 370, 371, 16/376, DIG. 43, 343, 375

[56] References Cited

FOREIGN PATENT DOCUMENTS

| | | | |
|---|---|---|---|
| 2336299 | 2/1975 | Fed. Rep. of Germany | 16/375 |
| 2210614 | 6/1980 | Fed. Rep. of Germany | 16/370 |
| 3101228 | 9/1982 | Fed. Rep. of Germany | 16/374 |

*Primary Examiner*—Nicholas P. Godici
*Assistant Examiner*—Edward A. Brown
*Attorney, Agent, or Firm*—Wenderoth, Lind & Ponack

[57] ABSTRACT

A wide-angle hinge for furniture doors, comprising a hinge boss fittable into a door wing and a hinge arm fastenable to a furniture side wall. The hinge boss and the hinge arm are connected to each other by means of hinge links which cross in a scissor-like manner. The latter-mentioned are provided with a locking means which is insurpassable, when the hinge is opened, but removable. The locking means is formed by a bracket fitted onto one of the hinge links which cross in a scissor-like manner.

5 Claims, 1 Drawing Sheet

WIDE-ANGLE HINGE

FIELD AND BACKGROUND OF THE INVENTION

The invention relates to a wide-angle hinge, in particular for furniture doors, comprising a hinge boss fittable into a door wing and a hinge arm fastenable to a furniture side wall, said hinge boss and hinge arm being connected with each other by means of hinge links which cross in a scissor-like manner and which are provided with a locking means.

Hinges of the above-described kind are particularly suitable for pieces of furniture with door wings abutting on the side wall. Generally, a maximum opening angle of 170 or 180° or, more generally speaking, of more than 90° is obtained with hinges of the afore-mentioned kind.

An opening angle of this type permits better access into the piece of furniture.

If a door wing adjoins an inner corner, it may happen with hinges of the above-described kind that the door wing, which is opened, hits against the adjoining door and damages the same or is damaged itself. It is complicated to provide this door wing with different hinges, i.e. with hinges having an opening angle of only 90°, since the place in which a door wing will be mounted at the piece of furniture might not be known, when the hinge is inserted into the door wings.

SUMMARY OF THE INVENTION

It is the object of the invention to provide a hinge of the kind specified in the introduction in which it is possible to limit the opening angle optionally, also when the hinge has already been mounted at the piece of furniture.

According to the invention this is achieved in that the locking means is insurpassable, when the hinge is opened, but removable.

In this way the same hinge can be used with or without the locking means.

It is advantageously provided that the locking means is a bracket which is fitted onto one of the hinge links which cross in a scissor-like manner.

The bracket is preferably of steel. It may equally be of plastics material, when the hinge is exposed to lower stresses.

An embodiment of the invention provides that the bracket has bolts at its marginal flanges which engage in holes of the hinge link, and that the bolts have an oblique portion at their sides directed towards the edge of the flange.

BRIEF DESCRIPTION OF THE FIGURES OF THE DRAWING

In the following an embodiment of the invention will be described in more detail with reference of the figures of the drawing in which.

DESCRIPTION OF THE PREFERRED EMBODIMENT

Figure 1:
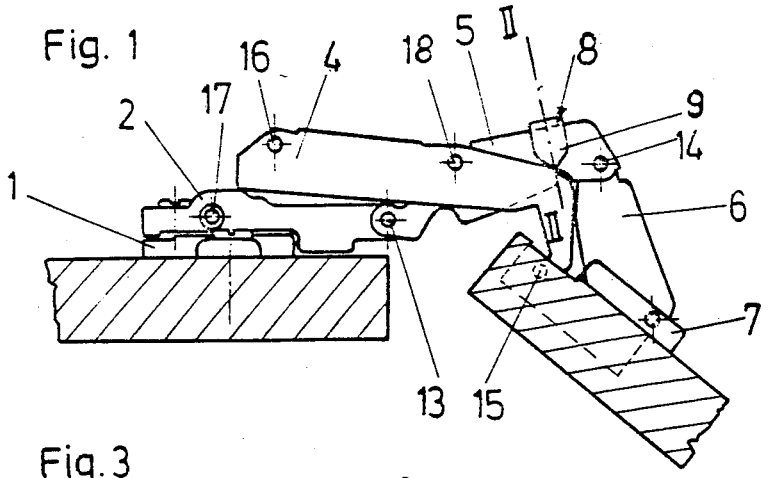
FIG. 1 shows a side view of a hinge according to the invention in an open position of about 110°.
Figure 3:
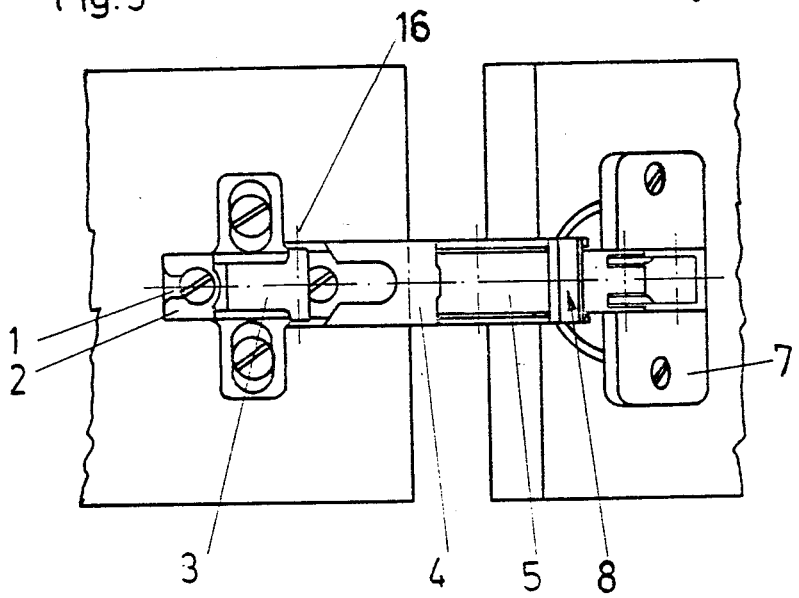
FIG. 3 shows a top view of a hinge according to the invention.
Figure 2:
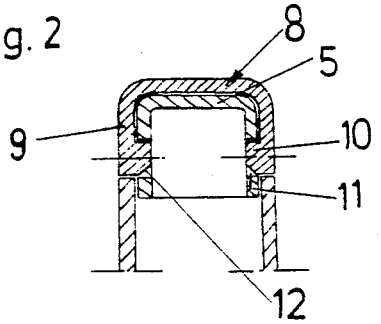
FIG. 2 shows a sectional view along line II—II of FIG. 1.
Figure 4:
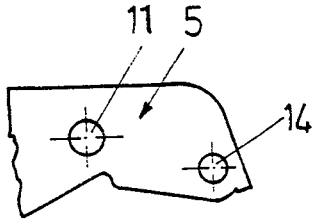
FIG. 4 shows a side view of the hinge link and the point of bearing of the lever.

The hinge according to the invention comprises a hinge arm 2 on the side of the piece of furniture and a hinge boss 7 on the side of the door wing, said hinge arm and hinge boss being linked to each other by a pair of hinge links 4 and 5 which are connected in a common central hinge point 18 in a scissor-like manner. The hinge link 5 is in this arrangement pivotally connected with the hinge boss 7, which is on the side of the door wing, by means of a connecting lever 6. The hinge link 4 is also pivotally connected with the hinge arm 2, which is on the side of the piece of furniture, by means of a connecting lever 3.

The hinge arm 2 is mounted on a mounting plate 1.

The hinge link 4 is forked at its hook-like end, the hinge link 5 projecting through the recess between the two prongs in which the common hinge point 18 is arranged. The central hinge link 5 is thus mounted at three hinge axles, first at the hinge axle 13 at the hinge arm 2 which is on the side of the piece of furniture, second at the central common hinge axle 18 and third at the hinge axle 14 connecting the connecting lever 6 with the hinge link 5. On the side of the door wing, the hinge link 4 is mounted at the hinge axle 15 in the hinge boss 7, and on the side of the piece of furniture the hinge link 4 is mounted at the hinge axle 16 at the connecting lever 3. The connecting lever 3 is with its other end mounted at the hinge axle 17 at the hinge arm 2.

As can be seen from the figures of the drawings, the hinge lever 5 is at the side flanges provided with two holes 11.

The bracket 8 is disposed astride on the hinge link 5.

The bolts 10 engage in the holes 11 of the hinge link 5, the bracket 8 thus being locked.

Towards the edge of the flange, the bolts 10 are provided with oblique portions 12 which facilitate fitting of the bracket 8 onto the hinge link 5.

The bracket 8 is advantageously of steel so that its side flanges 9 can spring apart. On the other hand, steel is strong enough to take up greater laterally acting forces, which may occur, when the door is flung open without care. The bracket 8 can be easily removed by means of a screw driver.

What is claimed is:

1. In a wide-angle hinge for use in mounting a door to an article of furniture, said hinge including a hinge boss to be mounted on the door, a hinge arm to be mounted on a side wall of the article of furniture, and hinge links connecting said hinge boss and said hinge arm and crossing in a scissorlike manner, the improvement comprising means, removably mounted on a first of said hinge links, for abutting against a second of said hinge links and thereby for limiting the opening angle of said hinge, said means comprising:

a bracket fittable over a selected position of said first hinge link, said bracket and said first hinge link having engaging means retaining said bracket on said first hinge link at said selected position thereof.

2. The wide-angle hinge claimed in claim 1, wherein said first hinge link has a U-shaped configuration including a pair of spaced flanges, said bracket has a U-shaped configuration including a pair of spaced flanges, and said bracket fits over said first hinge link with said flanges of said bracket positioned outwardly of said flanges of said first hinge link, such that said second hinge link is abuttable with said flanges of said bracket.

3. The wide-angle hinge claimed in claim 2, wherein said engaging means comprise openings in said flanges of said first hinge link and projections extending inwardly from said flanges of said bracket and fittable into said openings.

4. The wide-angle hinge claimed in claim 3, wherein said projections have beveled surfaces, for facilitating fitting of said bracket over said first hinge link.

5. The wide-angle hinge claimed in claim 2, wherein said bracket is formed of a resilient material.

* * * * *